US007006058B2

(12) United States Patent
Tokunaga

(10) Patent No.: US 7,006,058 B2
(45) Date of Patent: Feb. 28, 2006

(54) METHOD OF DRIVING A PLASMA DISPLAY PANEL

(75) Inventor: Tsutomu Tokunaga, Yamanashi (JP)

(73) Assignees: Pioneer Corporation, Tokyo (JP); Shizuoka Pioneer Corporation, Shizuoka (JP)

( * ) Notice: Subject to any disclaimer, the term of this patent is extended or adjusted under 35 U.S.C. 154(b) by 344 days.

(21) Appl. No.: 10/326,165

(22) Filed: Dec. 23, 2002

(65) Prior Publication Data

US 2003/0132897 A1 Jul. 17, 2003

(30) Foreign Application Priority Data

Jan. 15, 2002 (JP) ..... 2002-005537

(51) Int. Cl.
*G09G 3/28* (2006.01)

(52) U.S. Cl. ..... 345/60; 345/68

(58) Field of Classification Search ..... 345/60–68, 345/692, 693; 315/169.4
See application file for complete search history.

(56) References Cited

U.S. PATENT DOCUMENTS 6,175,194 B1 * 1/2001 Saegusa et al. ..... 315/169.4
6,292,159 B1 * 9/2001 Someya et al. ..... 345/60
6,495,968 B1 * 12/2002 Tokunaga ..... 315/169.4
6,552,736 B1 * 4/2003 Honda et al. ..... 345/691
6,614,413 B1 * 9/2003 Tokunaga et al. ..... 345/63
6,646,625 B1 * 11/2003 Shigeta et al. ..... 345/63
6,703,990 B1 * 3/2004 Tokunaga et al. ..... 345/60
6,768,479 B1 * 7/2004 Nakamura ..... 345/60
6,870,521 B1 * 3/2005 Iwami ..... 345/60
2002/0105485 A1 * 8/2002 Shizaki et al. ..... 345/60

FOREIGN PATENT DOCUMENTS

JP 2001-312244 11/2001

* cited by examiner

*Primary Examiner*—Xiao Wu
(74) *Attorney, Agent, or Firm*—Sughrue Mion, PLLC

(57) ABSTRACT

Fields define a picture signal, and each field is divided into a plurality of sub fields. A plasma display panel includes discharge cells formed at crossing portions of row and column electrodes. A sub field group includes a head sub field and at least one subsequent sub field. Each sub field of the sub field group includes a selected writing address stage for selectively discharging a discharge cell in question so as to set the discharge cell into a lighting mode in accordance with the picture signal. At least one sub field subsequent to the sub field group includes a light emission maintaining stage for repeatedly maintaining discharge of the discharge cell in only the lighting mode for a number of times in accordance with weighting of the plurality of sub fields. One of the one sub field includes a selected light extinction address stage for selectively discharging only a discharge cell which undergoes the light emission maintaining stage in an immediately preceding sub field, in accordance with the picture signal so as to set the discharge cell in a light extinguishing mode.

11 Claims, 11 Drawing Sheets

FIG. 2

| GRADATION LEVELS | CONVERSION TABLE | | | | | | | | | | | | | LIGHT EMISSION DRIVING PATTERN | | | | | | | | | | | | DISPLAY LUMINANCE |
|---|---|---|---|---|---|---|---|---|---|---|---|---|---|---|---|---|---|---|---|---|---|---|---|---|---|---|
| | PDs | GD 1 | 2 | 3 | 4 | 5 | 6 | 7 | 8 | 9 | 10 | 11 | 12 | SF 1 | SF 2 | SF 3 | SF 4 | SF 5 | SF 6 | SF 7 | SF 8 | SF 9 | SF 10 | SF 11 | SF 12 | |
| 1 | 0000 | 1 | 0 | 0 | 0 | 0 | 0 | 0 | 0 | 0 | 0 | 0 | 0 | ● | | | | | | | | | | | | 0 |
| 2 | 0001 | 0 | 1 | 0 | 0 | 0 | 0 | 0 | 0 | 0 | 0 | 0 | 0 | ○ | ● | | | | | | | | | | | 1 |
| 3 | 0010 | 0 | 0 | 1 | 0 | 0 | 0 | 0 | 0 | 0 | 0 | 0 | 0 | ○ | ○ | ● | | | | | | | | | | 3 |
| 4 | 0011 | 0 | 0 | 0 | 1 | 0 | 0 | 0 | 0 | 0 | 0 | 0 | 0 | ○ | ○ | ○ | ● | | | | | | | | | 7 |
| 5 | 0100 | 0 | 0 | 0 | 0 | 1 | 0 | 0 | 0 | 0 | 0 | 0 | 0 | ○ | ○ | ○ | ○ | ● | | | | | | | | 14 |
| 6 | 0101 | 0 | 0 | 0 | 0 | 0 | 1 | 0 | 0 | 0 | 0 | 0 | 0 | ○ | ○ | ○ | ○ | ○ | ● | | | | | | | 25 |
| 7 | 0110 | 0 | 0 | 0 | 0 | 0 | 0 | 1 | 0 | 0 | 0 | 0 | 0 | ○ | ○ | ○ | ○ | ○ | ○ | ● | | | | | | 39 |
| 8 | 0111 | 0 | 0 | 0 | 0 | 0 | 0 | 0 | 1 | 0 | 0 | 0 | 0 | ○ | ○ | ○ | ○ | ○ | ○ | ○ | ● | | | | | 59 |
| 9 | 1000 | 0 | 0 | 0 | 0 | 0 | 0 | 0 | 0 | 1 | 0 | 0 | 0 | ○ | ○ | ○ | ○ | ○ | ○ | ○ | ○ | ● | | | | 84 |
| 10 | 1001 | 0 | 0 | 0 | 0 | 0 | 0 | 0 | 0 | 0 | 1 | 0 | 0 | ○ | ○ | ○ | ○ | ○ | ○ | ○ | ○ | ○ | ● | | | 117 |
| 11 | 1010 | 0 | 0 | 0 | 0 | 0 | 0 | 0 | 0 | 0 | 0 | 1 | 0 | ○ | ○ | ○ | ○ | ○ | ○ | ○ | ○ | ○ | ○ | ● | | 157 |
| 12 | 1011 | 0 | 0 | 0 | 0 | 0 | 0 | 0 | 0 | 0 | 0 | 0 | 1 | ○ | ○ | ○ | ○ | ○ | ○ | ○ | ○ | ○ | ○ | ○ | ● | 205 |
| 13 | 1100 | 0 | 0 | 0 | 0 | 0 | 0 | 0 | 0 | 0 | 0 | 0 | 0 | ○ | ○ | ○ | ○ | ○ | ○ | ○ | ○ | ○ | ○ | ○ | ○ | 255 |

● : SELECTED LIGHT-EXTINCTION DISCHARGE
○ : LIGHT EMITTING SF

FIG.6

| GRADATION LEVEL | PDs | GD 1 2 3 | GD 4 · · · · · · · · · 12 | LIGHT EMISSION PATTERN SF 1 | SF 2 | SF 3 | SF 4 | SF 5 | SF 6 | SF 7 | SF 8 | SF 9 | SF 10 | SF 11 | SF 12 | LUMINANCE |
|---|---|---|---|---|---|---|---|---|---|---|---|---|---|---|---|---|
| 1 | 0000 | 0 0 0 | 1 1 1 1 1 1 1 1 1 | | | | | | | | | | | | | 0 |
| 2 | 0001 | 1 0 0 | 1 1 1 1 1 1 1 1 1 | ◎ | | | | | | | | | | | | 1 |
| 3 | 0010 | 1 1 0 | 1 1 1 1 1 1 1 1 1 | ◎ | ◎ | | | | | | | | | | | 3 |
| 4 | 0011 | 1 1 1 | 0 1 1 1 1 1 1 1 1 | ◎ | ◎ | ◎ | ● | | | | | | | | | 7 |
| 5 | 0100 | 1 1 1 | 1 0 1 1 1 1 1 1 1 | ◎ | ◎ | ◎ | ○ | ● | | | | | | | | 13 |
| 6 | 0101 | 1 1 1 | 1 1 0 1 1 1 1 1 1 | ◎ | ◎ | ◎ | ○ | ○ | ● | | | | | | | 25 |
| 7 | 0110 | 1 1 1 | 1 1 1 0 1 1 1 1 1 | ◎ | ◎ | ◎ | ○ | ○ | ○ | ● | | | | | | 39 |
| 8 | 0111 | 1 1 1 | 1 1 1 1 0 1 1 1 1 | ◎ | ◎ | ◎ | ○ | ○ | ○ | ○ | ● | | | | | 59 |
| 9 | 1000 | 1 1 1 | 1 1 1 1 1 0 1 1 1 | ◎ | ◎ | ◎ | ○ | ○ | ○ | ○ | ○ | ● | | | | 84 |
| 10 | 1001 | 1 1 1 | 1 1 1 1 1 1 0 1 1 | ◎ | ◎ | ◎ | ○ | ○ | ○ | ○ | ○ | ○ | ● | | | 117 |
| 11 | 1010 | 1 1 1 | 1 1 1 1 1 1 1 0 1 | ◎ | ◎ | ◎ | ○ | ○ | ○ | ○ | ○ | ○ | ○ | ● | | 157 |
| 12 | 1011 | 1 1 1 | 1 1 1 1 1 1 1 1 0 | ◎ | ◎ | ◎ | ○ | ○ | ○ | ○ | ○ | ○ | ○ | ○ | ● | 205 |
| 13 | 1100 | 1 1 1 | 1 1 1 1 1 1 1 1 1 | ◎ | ◎ | ◎ | ○ | ○ | ○ | ○ | ○ | ○ | ○ | ○ | ○ | 255 |

◎ : SELECTED WRITING

● : SELECTED LIGHT EXTINCTION

○ : SUSTAINED LIGHT EMISSION SF

FIG. 9

| GRADATION LEVEL | PDs | GD 1 | GD 2 | GD 3 | GD 4 | · · · · · · · · · · | GD 12 | SF 1 | SF 2 | SF 3 | SF 4 | SF 5 | SF 6 | SF 7 | SF 8 | SF 9 | SF 10 | SF 11 | SF 12 | LUMINANCE |
|---|---|---|---|---|---|---|---|---|---|---|---|---|---|---|---|---|---|---|---|---|
| 1 | 0000 | 0 | 0 | 1 | 1 | 1 | 1 | 1 | 1 | 1 | 1 | 1 | 1 | 1 | 1 | 1 | 1 | 1 | 1 | 0 |
| 2 | 0001 | 1 | 0 | 1 | 1 | 1 | 1 | 1 | 1 | 1 | 1 | 1 | 1 | 1 | 1 | 1 | 1 | 1 | 1 | 1 |
| 3 | 0010 | 1 | 1 | 0 | 1 | 1 | 1 | 1 | 1 | 1 | 1 | 1 | 1 | 1 | 1 | 1 | 1 | 1 | 1 | 3 |
| 4 | 0011 | 1 | 1 | 1 | 0 | 1 | 1 | 1 | 1 | 1 | 1 | 1 | 1 | 1 | 1 | 1 | 1 | 1 | 1 | 7 |
| 5 | 0100 | 1 | 1 | 1 | 1 | 0 | 1 | 1 | 1 | 1 | 1 | 1 | 1 | 1 | 1 | 1 | 1 | 1 | 1 | 13 |
| 6 | 0101 | 1 | 1 | 1 | 1 | 1 | 0 | 1 | 1 | 1 | 1 | 1 | 1 | 1 | 1 | 1 | 1 | 1 | 1 | 25 |
| 7 | 0110 | 1 | 1 | 1 | 1 | 1 | 1 | 0 | 1 | 1 | 1 | 1 | 1 | 1 | 1 | 1 | 1 | 1 | 1 | 39 |
| 8 | 0111 | 1 | 1 | 1 | 1 | 1 | 1 | 1 | 0 | 1 | 1 | 1 | 1 | 1 | 1 | 1 | 1 | 1 | 1 | 59 |
| 9 | 1000 | 1 | 1 | 1 | 1 | 1 | 1 | 1 | 1 | 0 | 1 | 1 | 1 | 1 | 1 | 1 | 1 | 1 | 1 | 84 |
| 10 | 1001 | 1 | 1 | 1 | 1 | 1 | 1 | 1 | 1 | 1 | 0 | 1 | 1 | 1 | 1 | 1 | 1 | 1 | 1 | 117 |
| 11 | 1010 | 1 | 1 | 1 | 1 | 1 | 1 | 1 | 1 | 1 | 1 | 0 | 1 | 1 | 1 | 1 | 1 | 1 | 1 | 157 |
| 12 | 1011 | 1 | 1 | 1 | 1 | 1 | 1 | 1 | 1 | 1 | 1 | 1 | 0 | 1 | 1 | 1 | 1 | 1 | 1 | 205 |
| 13 | 1100 | 1 | 1 | 1 | 1 | 1 | 1 | 1 | 1 | 1 | 1 | 1 | 1 | 0 | 1 | 1 | 1 | 1 | 1 | 255 |

◎ : SELECTED WRITING

● : SELECTED LIGHT EXTINCTION

○ : SUSTAINED LIGHT EMISSION SF

METHOD OF DRIVING A PLASMA DISPLAY PANEL

BACKGROUND OF THE INVENTION

1. Field of the Invention

The present invention relates to a method of driving a plasma display panel including discharge cells arranged in a matrix fashion.

2. Description of the Related Art

In recent years, a plasma display panel (referred to as "PDP") in which a number of discharge cells are arranged in a matrix has been drawn attention as a two-dimensional image display panel. The PDP is directly driven by a digital image signal and the number of gradation levels (gradation sequence) of luminance (the number of luminance levels) expressable by the PDP is decided by the number of bits of an image data for each pixel included in the digital image signal. A sub field method is known as a gradation sequence display method for the PDP. The sub field method divides a display period of one field into a plurality of sub fields, and drives each cell for each sub field. One method for driving the PDP is disclosed in Japanese Patent Kokai No. 2001-312244.

In the sub field method, a display period of one field is divided into a plurality of sub fields. Each sub field includes an address period for setting each pixel in a lighting mode or a light extinguishing mode in accordance with the image data and a luminance maintaining period for only lighting a pixel in the lighting mode for a period corresponding to weighting of the sub field concerned. In other words, whether or not a discharge cell is illuminated within each sub field (address period) is decided, and only the discharge cell in the lighting mode is illuminated for a period (i.e., a luminance maintaining period) allocated to this sub field. Accordingly, one field may include one or more sub fields in a luminance state and one or more sub fields in a light extinguishment (nonluminance) state. Therefore, an intermediate luminance is created for that one field in accordance with a sum of the luminance periods of all the sub fields in that one field.

FIG. 1 of the accompanying drawings illustrates a typical example of a light emit driving format for the PDP. One field in an image signal is divided into twelve sub fields SF1 to SF12, so that driving of the PDP is executed for each sub field. Basically, each sub field includes an address stage Wc and a luminance maintaining stage Ic. The address stage Wc sets each discharge cell of the PDP in either a lighting mode (i.e., an operable mode) or a light extinguishing mode (i.e., a nonoperable mode) on the basis of the input image data. The luminance maintaining stage Ic illuminates only a discharge cell in the lighting mode for a period (number of times) in accordance with weighting of each sub field. It should be noted that an initial reset stage Rc is executed to initialize all discharge cells of the PDP to the lighting mode in only the first sub field SF1 at the front end (head) of the field, and a light elimination (extinction) stage E is executed in the last sub field SF12 at the rear end of the field.

FIG. 2 of the accompanying drawings shows relationship among pixel drive data GD obtained by applying a conversion process (will be described) to the pixel data, gradation levels (gradation sequence) corresponding to the pixel drive data GD, and a light emit driving pattern of the discharge cells in accordance with the pixel drive data GD. By sampling an image signal, for example, pixel data PD of 8 bits can be obtained. The pixel data PD then undergoes a multi-gradation process, so that multi-gradation image data $PD_S$ is generated, of which bit number is reduced to 4 bits, while maintaining the present number of gradation levels. The multi-gradation image data $PD_S$ is converted into the pixel driving data GD including first to twelfth bits in accordance with a conversion table shown in FIG. 2. Each of the first to twelfth bits corresponds to each of the sub fields SF1 to SF12.

FIG. 3 of the accompanying drawings illustrates application timing of various driving pulses to row electrodes and column electrodes of the PDP in accordance with the light emit driving format shown in FIG. 2. FIG. 3 shows a drive scheme by a selected light-extinction method (one reset-one selected light extinction address method).

First, in the initial reset stage $R_C$ of the sub field SF1, a reset pulse $RP_X$ having a negative polarity is applied to row electrodes $X_1$ to $X_n$. In parallel with application of such a reset pulse $RP_X$, a reset pulse $RP_Y$ having a positive polarity is applied to row electrodes $Y_1$ to $Y_2$. As a result of application of the reset pulses $RP_x$ and $RP_Y$, all discharge cells of the PDP are reset-discharged, so that wall electric charge of a certain amount is equally formed within each discharge cell. All the discharge cells are therefore initialized into the lighting mode (illumination mode).

Next, at the address stage Wc of each sub field, a pixel data pulse DP having a voltage corresponding to a logical level of a pixel driving data bit DB (DB1 to DB12) is generated. The pixel driving data bits DB1 to DB12 correspond to the first to twelfth bits of the pixel driving data GD. For example, at the address stage $W_C$ of the sub field SF1, a part corresponding to a first row within the pixel driving data bit DB1 is picked out and a pixel data pulse group $DP1_1$ including m pixel data pulses corresponding to the logical levels of the picked up part is applied to column electrodes $D_1$ to $D_m$. By executing the same operation on and after the second row of the pixel driving data bit DB1, a pixel data pulse group $DP1_i$ ($DP1_1$ to $DP1_n$) for each row is sequentially applied to column electrodes $D_1$ to $D_m$ in the address stage Wc of the sub field SF1.

Also in the address stage Wc, a scan pulse SP with a negative polarity is sequentially applied to row electrodes $Y_1$ to $Y_n$ at the same timing as each application timing of the pixel data pulse DP. In this case, discharge (selected light-extinction discharge) occurs only in a discharge cell at a crossing of the row electrode to which the scan pulse SP is applied and the column electrode to which the high voltage pixel data pulse is applied, and then the wall electric charge remaining in this discharge cell is eliminated.

According to such selected light-extinction discharge, the discharge cell that is initialized in the lighting mode at the reset stage RC shifts to the light extinguishing mode. On the other hand, the discharge cell, in which the above described selected light-extinction discharge does not occur, maintains a condition that it is initialized in the reset stage Rc, namely, the lighting mode.

Next, at the luminance maintaining stage Ic of each sub field, as shown in FIG. 3, a maintaining pulse IP ($IP_X$ and $IP_Y$) with a positive polarity is alternately applied to row electrodes $X_i$ ($X_1$ to $X_n$) and row electrodes $Y_i$ ($Y_1$ to $Y_n$). At the luminance maintaining stage Ic, the maintaining pulse IP is applied so that the numbers of the maintaining pulse IP applied to the sub fields SF1 to SF12 have a predetermined ratio. For example, in the case shown in FIG. 3, the ratio of the application numbers of the maintaining pulse IP for the sub fields are as follows;

SF1:SF2:SF3 . . . =2:4:6: . . .

A discharge cell in which the wall electric charge is remaining, namely, the discharge cell set in the lighting mode at the address stage Wc only performs the maintaining-discharge upon every application of the maintaining pulses $IP_X$ and $IP_Y$. Accordingly, the discharge cell set in the lighting mode maintains the light emitting condition (emission maintaining-discharge) for a period corresponding to the numbers of the discharging, which is allocated to each sub field as described above.

Then, only in the sub field SF12 at the rear end of the field, a light extinction stage E is executed. At this light extinction stage E, a light extinction pulse AP with a positive polarity (not illustrated) is generated and this light extinction pulse AP is applied to the column electrodes $D_1$ to $D_m$. In parallel with the application of the light extinction pulse AP, another light extinction pulse EP with a negative polarity is generated and is applied to each of the row electrodes $Y_1$ to $Y_n$. The simultaneous application of the light extinction pulses AP and EP causes the light extinction discharge within all the discharge cells in the PDP, so that the wall electric charges remaining in all the discharge cells are eliminated. As a result of such light extinction discharge, all the discharge cells in the PDP are set in the light extinction mode.

In the above described driving method, only a discharge cell in the light emitting state in the immediately preceding sub field is selectively eliminated and discharged at a selected light extinction address stage of the subject sub field only. Thus, the N (e.g., twelve) sub fields are sequentially lighted from the front (head) sub field, so that N+1 (thirteen) gradation sequence display is created. By summing up the numbers of the illumination of the maintaining-discharge in each sub field, the gradation sequence display is created in accordance with the input image signal.

Since a visual property of a human being has a logarithmic property, human's eyes are sensitive to variation in the gradation sequence (sequence of gradation levels) in a low luminance area. In the above described driving method, the number of the maintaining light emissions (i.e., the number of the maintaining pulses) in the sub field SF1 used for the lowest gradation level should be at least twice because the negative wall electric charge is needed to be formed on a row electrode Y, to which the scan pulse SP is applied at the selected light extinction address in the next sub field. Accordingly, a finer gradation sequence display is difficult. For example, it is impossible to reduce to the number of the maintaining light emissions to once.

SUMMARY OF THE INVENTION

An object of the present invention is to provide a plasma display panel (PDP) driving method that can improve a gradation sequence display ability in a low luminance area.

According to one aspect of the present invention, there is provided a method of driving a plasma display panel for each of a plurality of sub fields. The sub fields are arranged from a head sub field to a tail sub field. Each of a plurality of fields which define a picture signal is divided into the sub fields. The plasma display panel includes a plurality of discharge cells formed at a plurality of crossing portions of a plurality of row electrodes corresponding to a plurality of display lines respectively and a plurality of column electrodes arranged to crisscross the plurality of row electrodes. The method comprises the steps of providing a sub field group which includes the head sub field and at least one subsequent sub field, such that each sub field of the sub field group includes a selected writing address stage for selectively discharging a discharge cell in question so as to set the discharge cell into a lighting mode in accordance with the picture signal; and providing at least one sub field subsequent to the sub field group such that the at least one sub field includes a light emission maintaining stage for repeatedly maintaining discharge of the discharge cell in only the lighting mode for a number of times in accordance with weighting of the plurality of sub fields, wherein one of the at least one sub field includes a selected light extinction address stage for selectively discharging only a discharge cell which undergoes the light emission maintaining stage in an immediately preceding sub field, in accordance with the picture signal so as to set the discharge cell in a light extinguishing mode.

BRIEF DESCRIPTION OF THE DRAWINGS

FIG. 2 illustrates pixel driving data obtained by carrying out a conversion process to pixel data, together with corresponding gradation levels and a light emission drive pattern for discharge cells;

FIG. 6 shows multi-gradation-level pixel data and pixel drive data, together with corresponding gradation levels and a light emission drive pattern for discharge cells in the first embodiment;

FIG. 9 shows multi-gradation-level pixel data and pixel drive data, together with corresponding gradation levels and a light emission drive pattern for discharge cells in a second embodiment;

DETAILED DESCRIPTION OF THE INVENTION

Embodiments according to the present invention will be described with reference to the accompanying drawings.

First Embodiment

Figure 1:
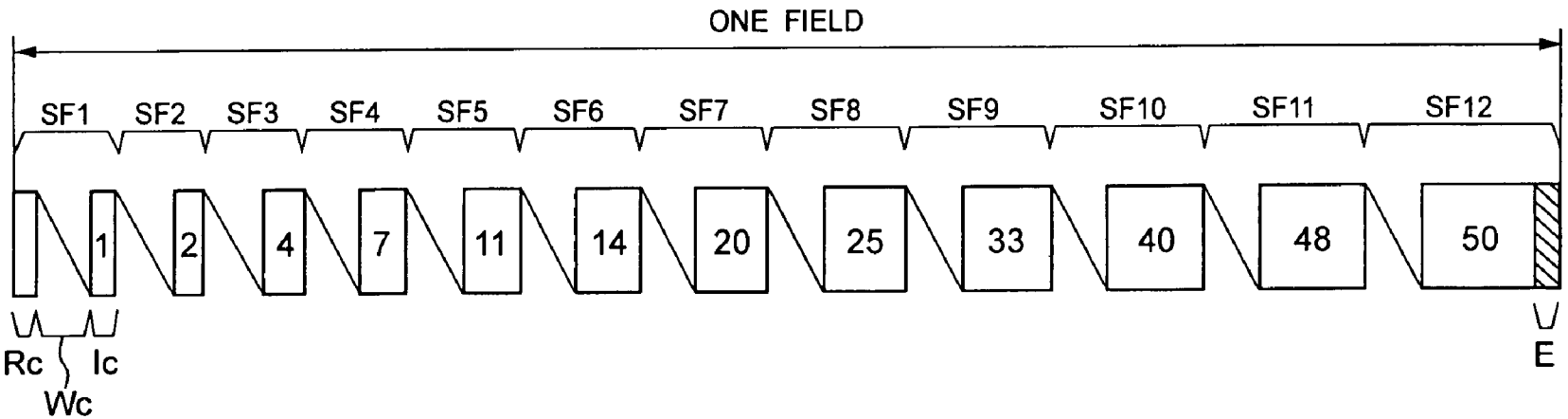
FIG. 1 illustrates a typical example of a light emission drive format for a PDP according to a one reset-one address method.
Figure 3:
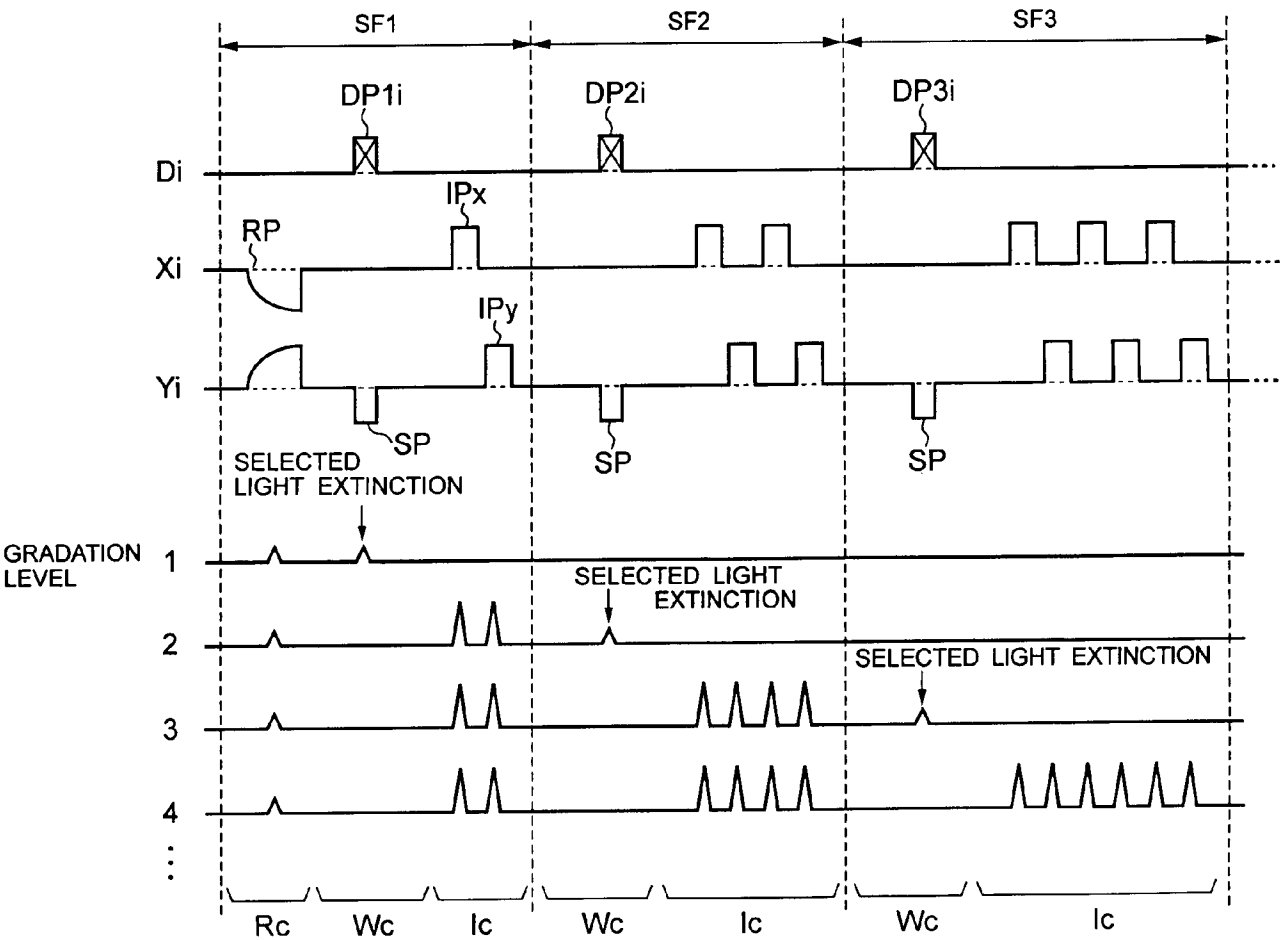
FIG. 3 illustrates application timing of various drive pulses to row electrodes and column electrodes of the PDP in accordance with the light emit drive format shown in FIG. 2.
Figure 4:
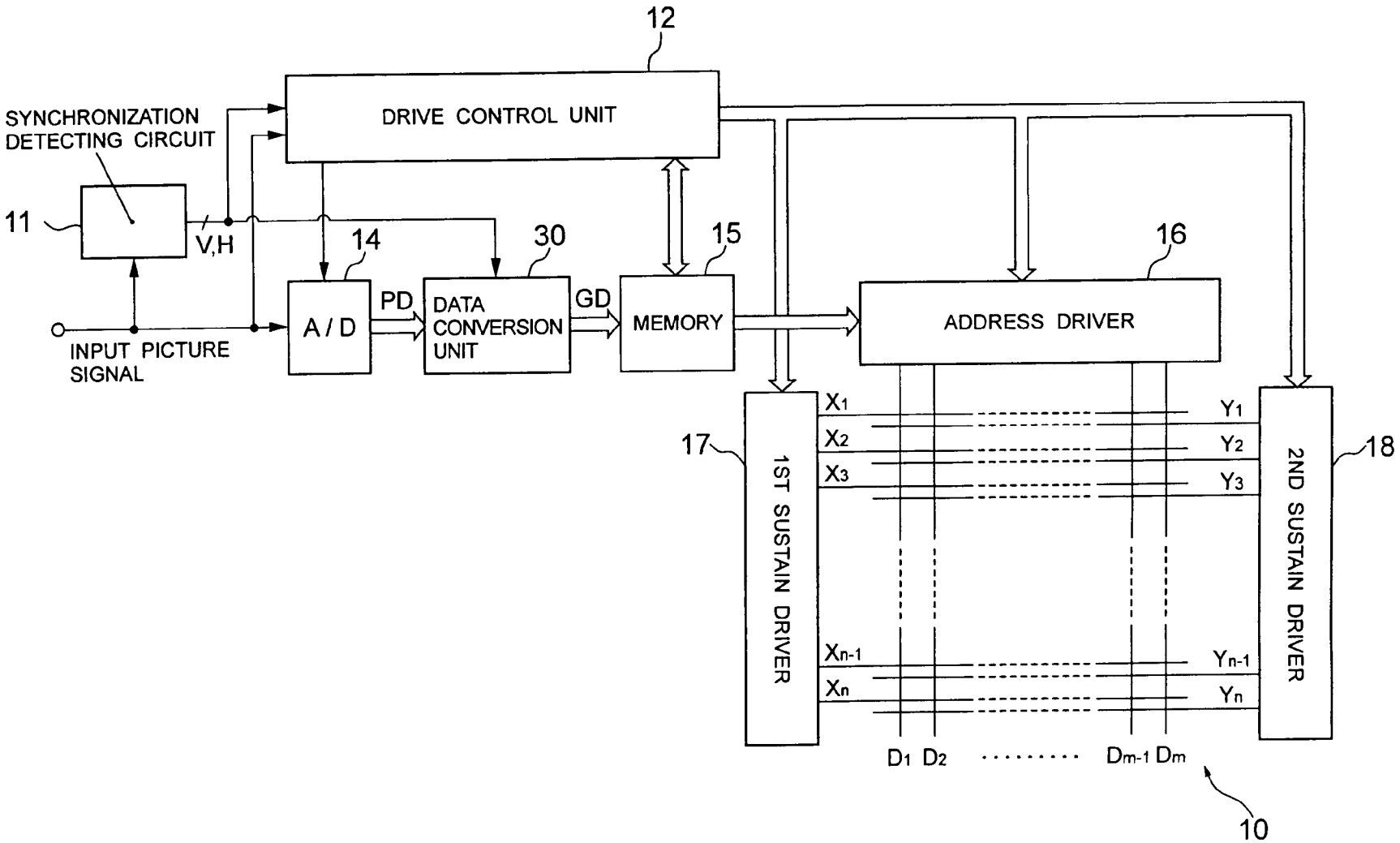
FIG. 4 is a block diagram for showing a schematic constitution of a display unit according to a first embodiment of the present invention.

Referring to FIG. 4, a schematic block diagram of a display unit according to a first embodiment of the present invention is illustrated.

The display unit shown in FIG. 4 is a plasma display unit, which includes a plasma display panel (PDP) 10 as a display device. This display unit includes the PDP 10 and a driving unit for the PDP 10. The driving unit includes a synchronization detecting circuit 11, a driving control circuit 12, an A/D converter 14, a data conversion circuit 30, a memory 15, an address driver 16, a first sustain driver 17 and a second sustain driver 18.

The PDP 10 includes column electrodes $D_1$ to $D_m$ (address electrodes) and row electrodes $X_1$ to $X_n$ and row electrodes $Y_1$ to $Y_n$ that are arranged orthogonally to the column electrodes. In the PDP 10, an effective row electrode corresponding to one display row is formed by a pair of a row electrode X and a row electrode Y. The column electrodes $D_1$ to $D_m$ are sectionalized into column electrodes $D_1$, $D_4$, $D_7, \ldots, D_{m-2}$ serving to emit red light, column electrodes $D_2, D_5, D_8, \ldots, D_{m-1}$ serving to emit green light and column electrodes $D_3, D_6, D_9, \ldots, D_m$ serving to emit blue light. At each crossing of each of the column electrodes $D_1$, $D_4$, $D_7, \ldots, D_{m-2}$ and each of the row electrodes X and Y, a red discharge cell for discharging to emit red is formed. At each crossing of each of the column electrodes $D_2, D_5, D_8, \ldots, D_{m-1}$ and each of the row electrodes X and Y, a green light emission cell for discharging to emit green is formed. At each crossing of each of the column electrodes $D_3, D_6, D_9, \ldots, D_m$ and each of the row electrodes X and Y, a blue light emission cell for discharging to emit blue is formed. Three discharge cells abutting with each other in a display line direction, namely, a red discharge cell, a green discharge cell and a blue discharge cell define one pixel.

The synchronization detecting circuit 11 generates a vertical synchronization signal V when the synchronization detecting circuit 11 detects a vertical synchronization signal in an analog picture signal. The synchronization detecting circuit 11 generates a horizontal synchronization signal H when the synchronization detecting circuit 11 detects a horizontal synchronization signal in the analog picture signal. The synchronization detecting circuit 11 supplies the vertical synchronization signal V and the horizontal synchronization signal H to the drive control circuit 12 and a multi gradation sequence processing circuit 31 (FIG. 5) in a data conversion circuit 30. The A/D converter 14 takes a sample of the picture signal (sampling operation) in response to a clock signal provided from the drive control circuit 12. Then the A/D converter 14 converts the sampled picture signal into, for example, the pixel data PD of eight bits for each pixel to supply the pixel data PD to the data conversion circuit 30.

Figure 5:
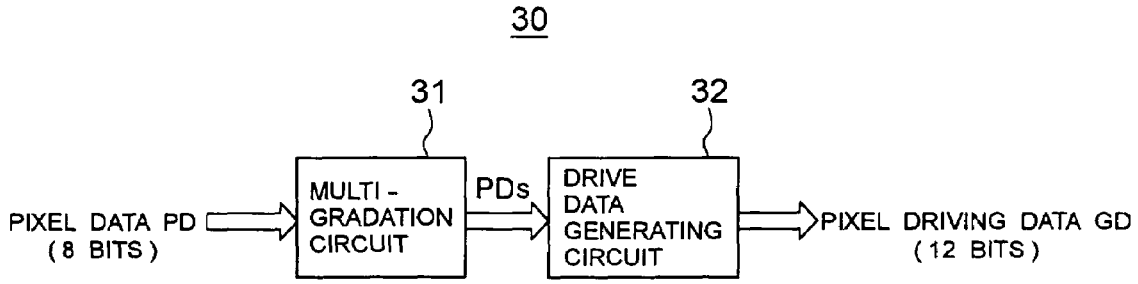
FIG. 5 is a block diagram for showing an inner constitution of a data conversion circuit shown in FIG. 4.

FIG. 5 is a block diagram for showing an inner constitution of the data conversion circuit 30. The data conversion circuit 30 includes the multi gradation sequence processing circuit 31 and a drive data generation circuit 32.

The multi gradation processing circuit 31 applies an error diffusion processing and a dither processing to the pixel data PD of eight bits. For example, in the error diffusion processing, the multi gradation processing circuit 31 defines the upper six bits of the pixel data PD as the display data and defines the remaining lower two bits thereof as the error data. Then, the multi gradation processing circuit 31 weight-adds each error data of the pixel data PD in connection with each of peripheral (surrounding/neighboring) pixels and reflects the result on the display data. According to such operation, the pseudo luminance for the lower two bits in an original pixel is expressed by the circumferential pixels. Therefore, the display data for six bits (not eight bits) can express the luminance gradation sequence equivalent to the 8-bit pixel data. Then, the multi gradation processing circuit 31 performs the dither processing to the error-diffusion-processed pixel data of six bits that is obtained by the error diffusion processing.

In the dither processing, a plurality of pixels abutting with each other are defined as one pixel unit, and dither coefficients including different coefficient values are allocated and added to the error diffusion processed pixel data corresponding to the pixels within this one pixel unit, respectively. In this manner, the multi gradation processing circuit 31 obtains the dither-added pixel data. As a result of such addition of the dither coefficients, if viewed as the pixel unit, the upper four bits of the dither-added pixel data is sufficient to express the luminance equivalent to the eight-bit pixel data. Thus, the multi gradation processing circuit 31 supplies the upper four bits of the dither-added pixel data, as the multi-gradation image data $PD_S$, to the drive data generation circuit 32.

The drive data generation circuit 32 converts the multi-gradation (grayscale) image data $PD_S$ of four bits into the pixel driving data GD including the first to twelfth bits in accordance with a conversion table shown in FIG. 6. Each of the first to twelfth bits corresponds to each of the sub fields SF1 to SF12. As will be described later, the sub fields SF1 to SF3 use the selected writing address in the address stage, and the sub fields SF4 to SF12 use the selected light-extinction address WI in the address stage in this embodiment. Accordingly, with respect to the first to thirteenth gradation sequences (gradation levels 1 to 13), the driving data generation circuit 32 converts the first to third bits of the pixel driving data GD corresponding to the sub fields SF1 to SF3 as shown in FIG. 6. Simultaneously, the driving data generation circuit 32 inverts the fourth to twelfth bits corresponding to the sub fields SF4 to SF12. This conversion process will be described in the order of events. For example, if the pixel data $PD_S$ is "0010" (gradation level 3), the driving data generation circuit 32 first extends "0010" to "001000000000". Next, the first to third bits are converted as shown in the conversion table shown in FIG. 6, thereby obtaining "110000000000". By inverting the fourth to twelfth bits, "110000000000" is converted into "110111111111". If the pixel data $PD_S$ is "0100" (gradation level 5), "0100" is extended to "000010000000", and this is converted into "111101111111" in the same manner as mentioned above.

In this way, the multi-gradation (halftone) processing circuit 31 and the driving data generation circuit 32 can convert the pixel data PD, capable of expressing 256 gradation levels in eight bits, into the pixel driving data GD of twelve bits including thirteen patterns in total as shown in FIG. 6.

In response to a write signal supplied from the driving control circuit 12, the memory 15 sequentially writes and stores the pixel driving data GD. When the writing of the pixel driving data $GD_{11}$ to $GD_{nm}$ for one screen (n rows, m columns) is complete, and the memory 15 receives a read signal from the driving control circuit 12, then the memory 15 sequentially reads each of the pixel driving data $GD_{11}$ to $GD_{nm}$ at the same bit digit for each row and supplies the pixel driving data $GD_{11}$ to $GD_{nm}$ to the address driver 16. In other words, the memory 15 divides the twelve-bit pixel driving data $GD_{11}$ to $GD_{nm}$ for one screen into twelve pixel driving data bits $GD1_{11\text{-}nm}$ to $GD12_{11\text{-}nm}$ as shown below:

$DB1_{11\text{-}nm}$: first bit of the pixel driving data $GD_{11\text{-}nm}$
$DB2_{11\text{-}nm}$: second bit of the pixel driving data $GD_{11\text{-}nm}$
$DB3_{11\text{-}nm}$: third bit of the pixel driving data $GD_{11\text{-}nm}$
$DB4_{11\text{-}nm}$: fourth bit of the pixel driving data $GD_{11\text{-}nm}$
$DB5_{11\text{-}nm}$: fifth bit of the pixel driving data $GD_{11\text{-}nm}$
$DB6_{11\text{-}nm}$: sixth bit of the pixel driving data $GD_{11\text{-}nm}$
$DB7_{11\text{-}nm}$: seventh bit of the pixel driving data $GD_{11\text{-}nm}$
$DB8_{11\text{-}nm}$: eighth bit of the pixel driving data $GD_{11\text{-}nm}$
$DB9_{11\text{-}nm}$: ninth bit of the pixel driving data $GD_{11\text{-}nm}$
$DB10_{11\text{-}nm}$: tenth bit of the pixel driving data $GD_{11\text{-}nm}$ $DB11_{11\text{-}nm}$: eleventh bit of the pixel driving data $GD_{11\text{-}nm}$ and $DB12_{11\text{-}nm}$: twelfth bit of the pixel driving data $GD_{11\text{-}nm}$.

Then, the memory 15 sequentially reads each of the $DB1_{11\text{-}nm}$, $DB2_{11\text{-}nm}$, . . . , $DB12_{11\text{-}nm}$ for each row in response to a read signal from the driving control circuit 12, and supplies them to the address driver 16.

The driving control circuit 12 generates a clock signal for the A/D converter 14 and the write and read signals for the memory 15 in synchronization with the horizontal synchronization signal H and vertical synchronization signal V.

Figure 7:
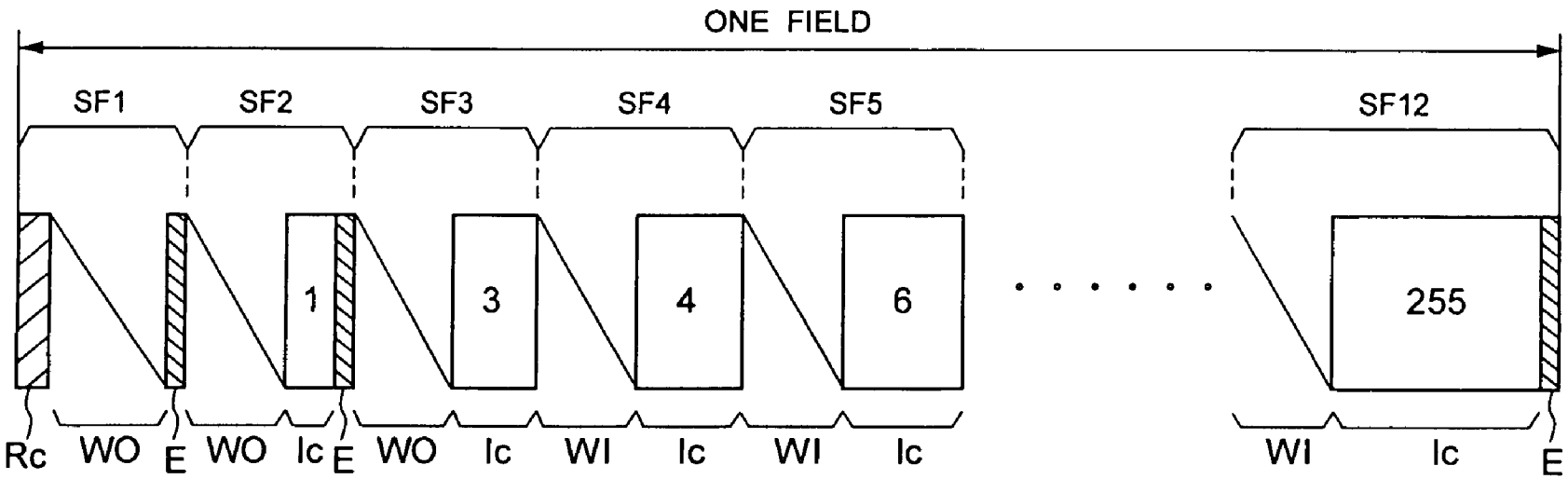
FIG. 7 shows a light emission drive format used in the first embodiment.

In accordance with a light emitting driving format shown in FIG. 7, the driving control circuit 12 supplies various timing signals, ultimately used to drive the PDP 10, to the address driver 16, the first sustain driver 17 and the second sustain driver 18, respectively.

In the light emission driving format shown in FIG. 7, one field in the picture signal is divided into twelve sub fields SF1 to SF12, and a PDP driving pattern is shown for (in) each sub field. The driving control circuit 12 decides light emitting patterns of the sub fields SF1 to SF12 on the basis of the pixel driving data GD including the first to twelfth bits shown in FIG. 6. Each sub field is configured by a combination of a selected writing address stage (WO) for setting each discharge cell of the PDP 10 in the lighting mode (namely, the operable mode) or a selected light-extinction address stage (WI) for setting each discharge cell in the light extinguishing mode (namely, the nonoperable mode) on the basis of the input picture signal, a light emission maintaining stage (Ic) for only illuminating a discharge cell set in the lighting mode for a period (number of times) in accordance with weighting of each sub field, a reset stage (Rc) and a light-extinction stage (E). More specifically, as shown in the conversion table in FIG. 6 and the light emission drive format in FIG. 7, the address stages in the sub fields SF1 to SF3 are defined as a selected writing address WO and the address stages in the sub fields SF4 to SF12 are defined as a selected light-extinction address WI. The sub field SF1 includes the reset stage Rc, the selected writing address WO and the light extinction stage E, and does not include the light emission maintaining stage Ic. The sub field SF2 includes the selected writing address WO, the light emission maintaining stage Ic and the light extinction stage E. The sub field SF3 only includes the selected writing address WO and the light emission maintaining stage Ic. The sub field SF3 does not include the light extinction stage E. Each of the sub fields SF4 to SF12 includes the selected light extinction address WI and the light emission maintaining stage Ic. The rear end (tail) sub field SF12 only includes the light extinction stage E.

Figure 8:
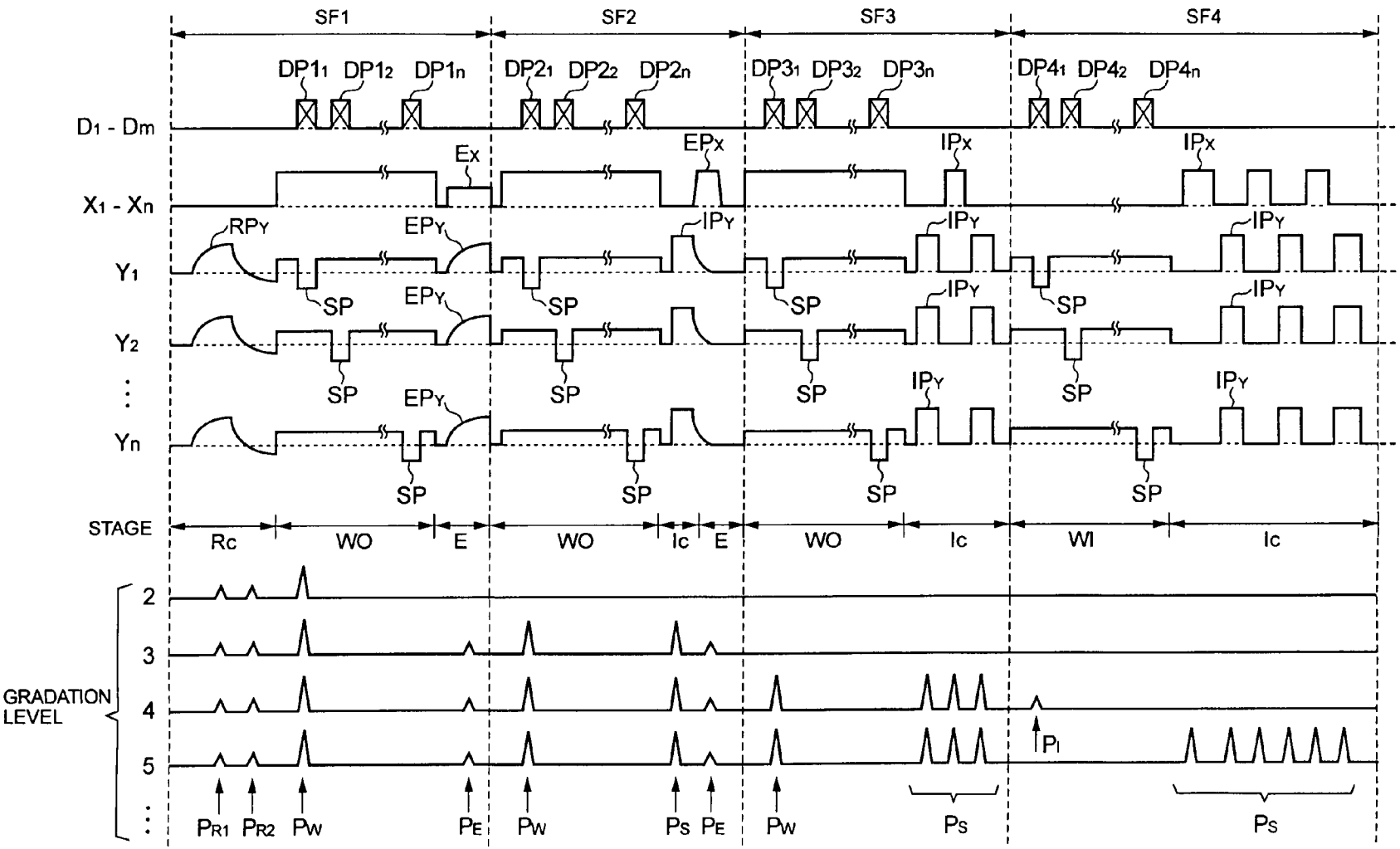
FIG. 8 is a time chart for showing application timing of various driving pulses to row electrodes and column electrodes of the PDP by an address driver, a first sustain driver and a second sustain driver in the first embodiment.

FIG. 8 is a time chart for showing application timing of driving pulses to the row and column electrodes of the PDP 10 by the address driver 16, the first sustain driver 17 and the second sustain driver 18, respectively in accordance with the light emit driving format shown in FIG. 7. With respect to the second to fifth gradation levels, a discharge condition corresponding to the pulse application is shown in the lower half of FIG. 8.

First, in the all reset stage Rc of the sub field SF1, the second sustain driver 18 applies a reset pulse $RP_Y$ having a positive polarity as shown in FIG. 8 to the row electrodes $Y_1$ to $Y_n$. In response to the reset pulse $RP_Y$, all discharge cells of the PDP 10 discharge electricity for resetting. The reset pulse $RP_Y$ does not have a rectangular wave pulse, but it has rising and falling edges of gentler slopes compared with the maintaining discharge pulse. Due to the application of the reset pulse $RP_Y$ of such a wave form, the complete (all-surface) writing discharge ($P_{R1}$) and the complete (all-surface) light extinction discharge ($P_{R2}$) in the reset stage Rc are very weak. Accordingly, the discharges $P_{R1}$ and $P_{R2}$ do not adversely affect the gradation sequence display even in the low luminance area. The reset stage Rc creates a certain amount of wall electric charge evenly in each of the discharge cells and therefore all the discharge cells are initialized to the light extinguishing mode.

Next, in the selected writing address stage WO of the sub field SF1, a predetermined voltage of positive polarity is applied to the row electrodes $X_1$ to $X_n$ by the first sustain driver 17. Then, the address driver 16 generates a pixel data pulse having a voltage corresponding to a logical level of the pixel driving data bit DB that is supplied from the memory 15. For example, the address driver 16 generates a high voltage pixel data pulse if the logical level of the pixel driving data bit DB is "1", and the address driver 16 generates a low voltage (0 volt) pixel data pulse if the logical level of the pixel driving data bit DB is "0". The address driver 16 applies the pixel data pulse group DP, including the pixel data pulse for one row, to the column electrodes $D_1$ to $D_m$. In the selected writing address stage WO of the sub field SF1, a portion corresponding to the first row in the pixel driving data bits $DB1_{11\text{-}nm}$, i.e., the $DB1_{11\text{-}1m}$, is first extracted. Then, the pixel data pulse group $DP1_1$ including m pixel data pulses corresponding to respective logical levels of the $DB1_{11\text{-}nm}$ is applied to the column electrodes $D_1$ to $D_m$. Next, a portion corresponding to the second row in the pixel driving data bits $DB1_{11\text{-}nm}$, namely the $DB1_{21\text{-}2m}$, is picked up, and the pixel data pulse group $DP1_2$ including m pixel data pulses corresponding to respective logical levels of the $DB1_{21\text{-}2m}$ is applied to the column electrodes $D_1$ to $D_m$. Subsequently, in the address stage Wc of the sub field SF1, the pixel data pulse groups $DP1_3$ to $DP1_n$ for each row are sequentially applied to the column electrodes $D_1$ to $D_m$ in the same manner.

In the address stage WO, the second sustain driver 18 generates scan pulses SP of a negative polarity as shown in FIG. 8 at the same timing as each application timing of the pixel data pulse group DP to sequentially apply the scan pulses SP to the row electrodes $Y_1$ to $Y_n$. In this case, a light emission $P_W$ is generated by the discharge (i.e., the selected writing discharge) only in the discharge cell at a crossing of the row electrode to which the scan pulse SP is applied and the column electrode to which the high voltage pixel data pulse is applied, and this discharge cell shifts to the lighting mode. FIG. 8 shows timing of the light emission $P_W$ of the first row electrode $Y_1$ due to the selected writing discharge.

After the address stage WO is complete, the complete (all-surface) light extinction stage E is executed. In the light extinction stage E, the first sustain driver 17 applies a certain voltage $E_X$ of a positive polarity to the row electrodes $X_1$ to $X_n$, and the second sustain driver 18 applies a light extinction pulse $EP_Y$ of a positive polarity to each of row electrodes $Y_1$ to $Y_n$. By the application of the light extinction pulses, the light extinction discharge $P_E$ occurs in all the discharge cells of the PDP 10, and all the wall electric charge remaining in the discharge cells is eliminated. According to such light extinction discharge, all the discharge cells in the PDP 10 are set in the light extinguishing mode.

As described above, in the sub field SF1, the writing-discharge light-emission $P_W$ for one time is used as a light emission of the gradation sequence display.

In the sub field SF2, the selected writing address stage WO is first executed, like the sub field SF1. If the pixel driving data bit DB has a light emission logical level ("1")

for designating the lighting of the pixel, the light emission $P_W$ is generated by the selected writing discharge.

Next, the light emission maintaining stage Ic is executed. The second sustain driver 18 applies the light emission maintaining pulse (i.e., the sustain pulse) $IP_Y$ of a positive polarity once to the row electrodes $Y_1$ to $Y_n$ substantially at the same time. The discharge cells in which the wall electric charge remains, namely, the discharge cells that are set in the lighting mode in the address stage WO, only maintain the discharging of electricity by the application of the maintaining pulse $IP_Y$, so that the light emission ($P_W$) is generated.

After the light emission maintaining stage Ic, the first sustain driver 17 applies a light extinction pulse $EP_X$ of a positive polarity to the row electrodes $X_1$ to $X_n$, so that the complete light extinction stage E is executed. Thus, all the discharge cells are set in the light extinguishing mode.

As described above, in the sub field SF2, two discharge light emissions in total, namely, the writing-discharge light emission $P_W$ for one time and a maintaining-discharge light emission $P_S$ for one time, are used as the light emission of the gradation sequence display.

In the sub field SF3, like the sub field SF1 and the sub field SF2, the selected writing address stage WO is executed, so that the light emission $P_W$ is generated by the selected writing discharge. Then, the emission maintaining stage Ic is executed. In other words, as shown in FIG. 8, the first sustain driver 17 and the second sustain driver 18 alternately apply the emission maintaining pulses $IP_x$ and $IP_Y$ of a positive polarity to the row electrodes $X_1$ to $X_n$ and row electrodes $Y_1$ to $Y_n$. The maintaining pulse $IP_x$ is applied once and the maintaining pulse $IP_Y$ is applied twice, so that the maintaining discharge light emission $P_s$ is generated three times in total.

As understood from the above, in the sub field SF3, the discharge light emission four times in total (namely, the writing discharge light emission $P_W$ for one time, and the maintaining discharge light emission $P_s$ for three times) are used as the light emission of the gradation sequence display.

In the sub fields SF4 to SF12, as described above, the selected light extinction address stage W1 and the emission maintaining stage Ic are executed. More in detail, the voltage is not applied to the row electrodes $X_1$ to $X_n$, but the scan pulse SP of a negative polarity is sequentially applied to the row electrodes $Y_1$ to $Y_n$ at the same timing as each application timing of the pixel data pulse DP. In this case, a very weak discharge (namely, a selected light extinction discharge $P_I$) is generated only in a discharge cell at a crossing of the row electrode to which the scan pulse SP is applied and the column electrode to which the high voltage pixel data pulse is applied. Thus, the wall electric charge remaining within this discharge cell is (selectively) eliminated. According to such selected light extinction discharge, the discharge cells in the lighting mode shift to the light extinguishing mode. On the other hand, the discharge cells, in which the selected extinguishment discharge does not occur, maintain the lighting mode.

In the light emission maintaining stage Ic of each sub field, as shown in FIG. 8, the light emission maintaining pulses $IP_x$ and $IP_Y$ of a positive polarity are alternately applied to the row electrodes $X_1$ to $X_n$ and the row electrodes $Y_1$ to $Y_n$. In the light emission maintaining stage Ic, the maintaining pulse IP is applied to each of the sub fields SF4 to SF12 for a predetermined number of times. For example, as shown in FIG. 6, the application number of times of maintaining pulse IP to each of the sub fields SF4 to SF12 is defined as follows:

| SF4 | SF5 | SF6 | SF7 | SF8 | SF9 | SF10 | SF11 | SF12 |
|---|---|---|---|---|---|---|---|---|
| 6 | 12 | 14 | 20 | 25 | 33 | 40 | 48 | 50 |

It should be noted that how many times the maintaining pulse IP should be applied to the sub fields SF2, SF3, SF4 to SF12 respectively are not limited to the above example, and it may be appropriately decided depending on various conditions.

The discharge cells in which the wall electric charge remains namely, the discharge cells maintained in the lighting mode, only keep discharging the electricity upon every application of the maintaining pulses $IP_x$ and $IP_Y$. Accordingly, the discharge cells set in the lighting mode maintain the lighting emission condition based on this emission maintaining discharge for the number of times allocated to the respective sub fields.

Only in the sub field SF12 at the rear end (not illustrated), the light extinguishing stage E is executed. In such light extinguishing stage E, a light extinguishment pulse AP of a positive polarity is generated and applied to the column electrodes $D_1$ to $D_m$. At the same time as the application timing of this light extinguishment pulse AP, a light extinguishment pulse EP of a negative polarity is also generated and applied to the row electrodes $Y_1$ to $Y_n$, respectively. By the simultaneous application of the light extinguishment pulses AP and EP, the light extinguishment discharge occurs in all the discharge cells in the PDP, so that all the wall electric charge remaining in the discharge cells is eliminated. According to such light extinction discharge, the all discharge cells in the PDP are set in the light extinguishing mode.

According to the above described driving method, therefore, in the sub fields SF4 to SF12 in which the selected light extinction address stage WI is executed, only the discharge cells maintained in the lighting mode repeat the light emissions for the above described number of times in the subsequent light emission maintaining stage Ic. Whether or not the discharge cell in question is set into the light extinguishing mode is determined by the pixel driving data GD. If a certain bit of the pixel driving data GD is a logical level "0", which represents the light extinguishment, then the selected light extinction discharge takes place in the address stage WI of the sub field corresponding to its bit digit, and the discharge cells are set into the light extinguishing mode. On the other hand, if a logical level of this bit is "1", the selected light extinction discharge does not take place, so that the discharge cells are maintained in the present mode. There is no chance of shifting the discharge cells from the light extinguishing mode to the lighting mode within the sub fields SF4 to SF12. Thus, once the discharge cells shifts to the light extinguishing mode, the discharge cells do not shift back to the lighting mode at any one of the address stages WI in the sub fields SF4 to SF12. Accordingly, after the sub field SF4, the lighting mode is only maintained till the selected light extinction discharge occurs in the sub fields shown by black circles in FIG. 6. In the each light emission maintaining stage Ic of each of sub fields shown by white circles existing during the above period, the light emissions are performed for the above described number of times. Accordingly, the total number of the selected writing discharges in the sub fields SF1 to SF3 and the maintaining discharges in the sub fields SF2 to SF12 decides the luminance of the middle (moderate) gradation.

For instance, the pixel driving data GD having thirteen data patterns as shown in FIG. 6 can express the middle luminance in thirteen gradation levels [0:1:3:7:13:25:39:59:84:117:157:205:255].

Therefore, it is possible to not only maintain the advantages of the one reset and one address method (namely, low electric power consumption, high contrast, and no fake outline), but also finely adjust the gradation levels in the low luminance area to improve the gradation sequence display capability.

Second Embodiment

Figure 10:
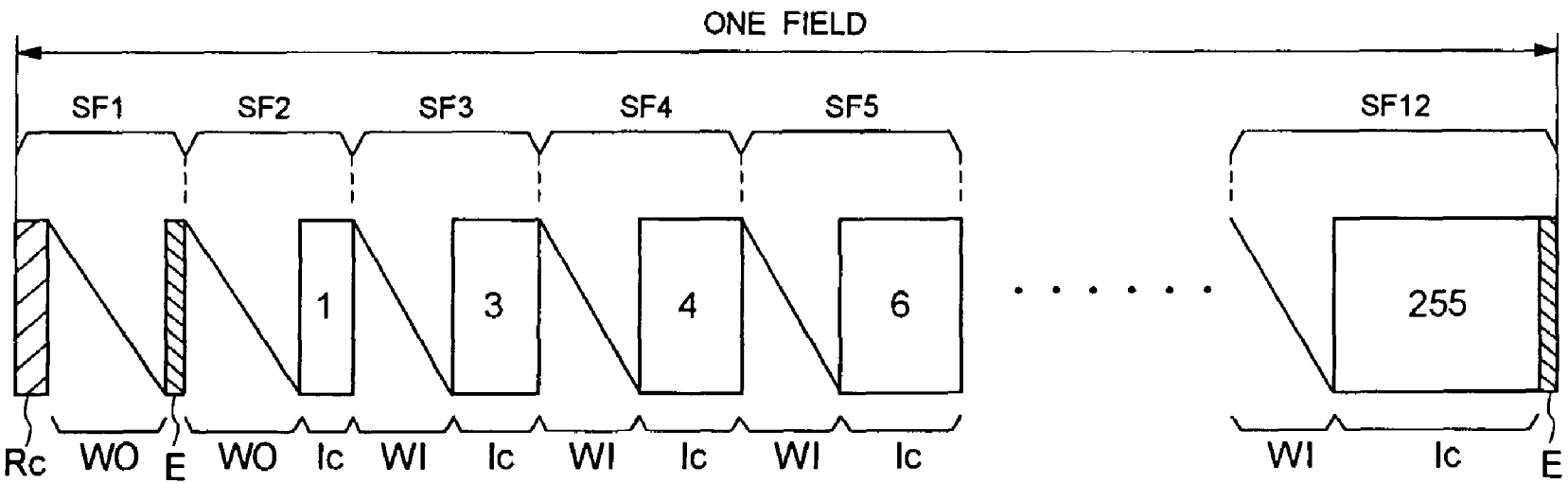
FIG. 10 shows a light emission drive format used in the second embodiment.
Figure 11:
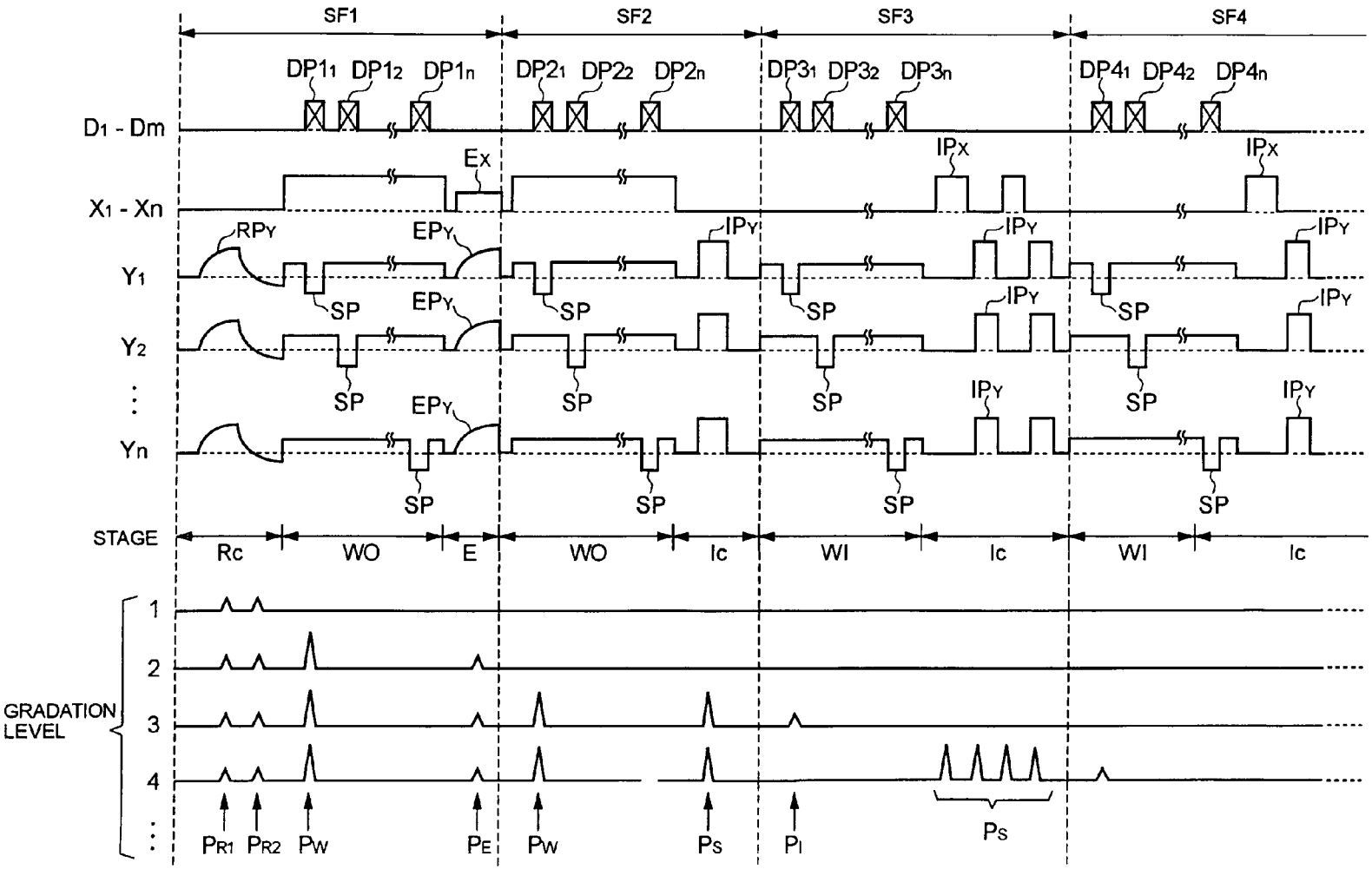
FIG. 11 is a time chart for showing application timing of various driving pulses to row electrodes and column electrodes of the PDP in the second embodiment.

A second embodiment of the present invention will be described with reference to FIGS. 9 to 11. FIG. 9 shows a conversion table and a light emission driving pattern of the driving data of the PDP 10 and FIG. 10 shows a light emission driving format. FIG. 11 is a time chart for showing application timing of driving pulses to the row electrode and the column electrode of the PDP 10.

The second embodiment is different from the first embodiment in that, as shown in FIGS. 9 and 10, the address stage in the sub fields SF1 and SF2 is defined as the selected writing address WO and the address stage in the sub fields SF3 to SF12 is defined as the selected light extinction address WI. More specifically, as shown in FIGS. 10 and 11, the sub field SF1 includes the reset stage Rc, the selected writing address WO and the light extinction stage E, but does not include the light emission maintaining stage Ic. The subfield SF2 only includes the selected writing address WO and the light emission maintaining stage Ic. The sub field SF2 does not include the light extinction stage E. Each of the sub fields SF3 to SF12 includes the selected light extinction address WI and the light emission maintaining stage Ic. The light extinction stage E is executed at the rear end sub field SF12 only.

FIG. 11 is a time chart, similar to FIG. 8, for showing application timing of driving pulses to the row electrodes and the column electrodes of the PDP 10 by the address driver 16, the first sustain driver 17 and the second sustain driver 18, respectively, in accordance with the light emission driving format shown in FIG. 9. The discharge conditions in response to the pulse application 11 for the first to fourth gradation levels are shown in the lower area in FIG. 11.

In the above described embodiments, the address stage in the sub fields SF1 to SF3 or the sub fields SF1 and SF2 is defined as the selected writing address. However, it should be noted that only the address stage of the sub field SF1 may be defined as the selected writing address. In this case, the sub field SF1 includes only the reset stage Rc (the complete writing+the complete light extinguishment), the selected writing address stage and the emission maintaining stage Ic (the number of the maintaining pulses is two).

In the above described embodiments, the reset stage Rc is provided preceding the address stage of the head sub field SF1 in one field. However, it may be provided for each plurality of fields, not for each field. Alternatively, the reset stage may not be provided. In this case, the number of times of the discharge light emissions that are not directly related to the gradation sequence display decreases, so that contrast is improved more.

In the first and second embodiments, since the rising and falling edges of the reset pulse or the rising and falling edges of the light extinction pulse have more gradual slopes than the maintaining discharge pulse, the complete writing discharge and the complete light extinction discharge in the reset stage or the light extinction discharge after the address stage is very weak. As a result, the discharge light emissions do not adversely influence the gradation sequence display even in the low luminance area.

Various modifications and changes may be made to the illustrated and described embodiments by those skilled in the art without departing from the spirit and scope of the present invention. Such modifications and changes are encompassed by the present invention defined by the appended claims.

This application is based on a Japanese patent application No. 2002-5537, and the entire disclosure thereof is incorporated herein by reference.

What is claimed is:

1. A method of driving a plasma display panel for each of a plurality of sub fields, wherein the plurality of sub fields are arranged from a head sub field to a tail sub field, each of a plurality of fields which define a picture signal is divided into the plurality of sub fields, and the plasma display panel includes a plurality of discharge cells formed at a plurality of crossing portions of a plurality of row electrodes corresponding to a plurality of display lines respectively and a plurality of column electrodes arranged to crisscross the plurality of row electrodes, the method comprising the steps of:

A) providing a sub field group which includes at least single sub field, starting from the head sub field, such that each sub field of the sub field group includes a selected writing address stage for selectively discharging a discharge cell in question so as to set the discharge cell into a lighting mode in accordance with the picture signal; and B) providing at least one sub field subsequent to the sub field group such that the at least one sub field includes a light emission maintaining stage for repeatedly maintaining discharge of the discharge cell in only the lighting mode for a number of times in accordance with weighting of the plurality of sub fields, wherein one of the at least one sub field includes a selected light extinction address stage for selectively discharging only a discharge cell which undergoes the light emission maintaining stage in an immediately preceding sub field, in accordance with the picture signal so as to set the discharge cell in a light extinguishing mode, and wherein the head sub field comprises only the selected writing address stage and a light extinction stage for discharging a discharge cell in the lighting mode so as to shift the discharge cell to the light extinguishing mode.

2. The method of driving a plasma display panel according to claim 1, wherein the one field is divided into N sub fields, the N sub fields are lighted in turn from the head sub field so that N+1 gradation levels result.

3. A method of driving a plasma display panel for each of a plurality of sub fields, wherein the plurality of sub fields are arranged from a head sub field to a tail sub field, each of a plurality of fields which define a picture signal is divided into the plurality of sub fields, and the plasma display panel includes a plurality of discharge cells formed at a plurality of crossing portions of a plurality of row electrodes corresponding to a plurality of display lines respectively and a plurality of column electrodes arranged to crisscross the plurality of row electrodes, the method comprising the steps of:

A) providing a sub field group which includes at least single sub field, starting from the head sub field, such that each sub field of the sub field group includes a selected writing address stage for selectively discharging a discharge cell in question so as to set the discharge cell into a lighting mode in accordance with the picture signal; and B) providing at least one sub field subsequent to the sub field group such that the at least one sub field includes a light emission maintaining stage for repeatedly maintaining discharge of the discharge cell in only the lighting mode for a number of times in accordance with weighting of the plurality of sub fields, wherein one of the at least one sub field includes a selected light extinction address stage for selectively discharging only a discharge cell which undergoes the light emission maintaining stage in an immediately preceding sub field, in accordance with the picture signal so as to set the discharge cell in a light extinguishing mode, and wherein the head sub field comprises only a reset stage for discharging all the discharge cells substantially at the same time so as to set all the discharge cells to the lighting mode, and then discharging all the discharge cells for light extinguishment, the selected writing address stage, and a light extinction stage for discharging a discharge cell in the lighting mode so as to shift the discharge cell to the light extinguishing mode.

4. The method of driving a plasma display panel according to claim 3, wherein the one field is divided into N sub fields, the N sub fields are lighted in turn from the head sub field so that N+1 gradation levels result.

5. A method of driving a plasma display panel for each of a plurality of sub fields, wherein the plurality of sub fields are arranged from a head sub field to a tail sub field, each of a plurality of fields which define a picture signal is divided into the plurality of sub fields, and the plasma display panel includes a plurality of discharge cells formed at a plurality of crossing portions of a plurality of row electrodes corresponding to a plurality of display lines respectively and a plurality of column electrodes arranged to crisscross the plurality of row electrodes, the method comprising the steps of:

A) providing a sub field group which includes at least single sub field, starting from the head sub field, such that each sub field of the sub field group includes a selected writing address stage for selectively discharging a discharge cell in question so as to set the discharge cell into a lighting mode in accordance with the picture signal; and B) providing at least one sub field subsequent to the sub field group such that the at least one sub field includes a light emission maintaining stage for repeatedly maintaining discharge of the discharge cell in only the lighting mode for a number of times in accordance with weighting of the plurality of sub fields, wherein one of the at least one sub field includes a selected light extinction address stage for selectively discharging only a discharge cell which undergoes the light emission maintaining stage in an immediately preceding sub field, in accordance with the picture signal so as to set the discharge cell in a light extinguishing mode, and wherein each sub field except the head sub field in the sub field group includes the light emission maintaining stage after the selected writing address stage.

6. The method of driving a plasma display panel according to claim 4, wherein the one field is divided into N sub fields, the N sub fields are lighted in turn from the head sub field so that N+1 gradation levels result.

7. A method of driving a plasma display panel for each of a plurality of sub fields, wherein the plurality of sub fields are arranged from a head sub field to a tail sub field, each of a plurality of fields which define a picture signal is divided into the plurality of sub fields, and the plasma display panel includes a plurality of discharge cells formed at a plurality of crossing portions of a plurality of row electrodes corresponding to a plurality of display lines and a plurality of column electrodes arranged to crisscross the plurality of row electrodes, the method comprising the steps of:

A) providing a sub field group which includes at least two continuous sub fields, starting from the head sub field, such that each said sub field of the sub field group includes a selected writing address stage for selectively causing said discharge cell in question to perform writing-discharge in accordance with the picture signal, so as to set the discharge cell into a lighting mode; and B) providing a plurality of subsequent sub fields following the sub field group such that each said subsequent sub field includes a light emission maintaining stage for causing only the discharge cell set in the lighting mode to repeatedly perform light-emission-sustaining discharge for a number of times in accordance with weighting of the plurality of sub fields, wherein one of said plurality of subsequent sub fields includes a selected light-extinction address stage for selectively causing only the discharge cell which performs the light-emission-sustaining discharge in an immediately preceding sub field, to perform light-extinction discharge in accordance with the picture signal so as to set the discharge cell into a light extinguishing mode, and wherein one field is divided into N sub fields, the N sub fields are lighted in turn from the head sub field so that N+1 gradation levels result.

8. A method of driving a plasma display panel, wherein a field corresponding to a portion of a picture signal is divided into a plurality of sub fields, arranged from a head sub field to a tail sub field and wherein the method comprises:

providing a selected writing address stage in the head sub field, wherein the selected writing address stage selectively discharges a discharge cell of the plasma display panel in accordance with the picture signal to place the discharge cell in a lighting mode; and providing a first subsequent sub field after the head sub field, wherein the first subsequent sub field includes a light emission maintaining stage and a selected light extinction address stage, wherein the light emission maintaining stage maintains a discharge of a discharge cell previously set the lighting mode for a number of times in accordance with a weighting assigned to the first subsequent sub field, wherein the selected light extinction address stage selectively discharges a discharge cell, in which a discharge has been maintained during a light emission maintaining stage in an immediately preceding sub field and in accordance with the picture signal, to place the discharge cell in a light extinguishing mode, and wherein the head sub field does not comprise a light emission maintaining stage.

9. The method as claimed in claim 8, wherein the head sub field comprises a light extinction stage for discharging the discharge cell in the lighting mode to shift the discharge cell from the lighting mode to the light extinguishing mode.

10. The method as claimed in claim 9, wherein the light extinction stage in the head sub field is subsequent to the selected writing address stage in the head sub field.

11. A method of driving a plasma display panel for each of a plurality of sub fields, wherein the plurality of sub fields are arranged from a head sub field to a tail sub field, each of a plurality of fields which define a picture signal is divided into the plurality of sub fields, and the plasma display panel includes a plurality of discharge cells formed at a plurality of crossing portions of a plurality of row electrodes corresponding to a plurality of display lines and a plurality of column electrodes arranged to crisscross the plurality of row electrodes, the method comprising the steps of:

A) providing a first sub field group which includes a plurality of continuous sub fields, starting from the head sub field, such that each sub field of the first sub field group includes a selected writing address stage for selectively causing a discharge cell in question to perform writing-discharge in accordance with the picture signal, so as to set the discharge cell into a lighting mode, and also includes a light emission maintaining stage for causing only the discharge cell set in the lighting mode to repeatedly perform light-emission-sustaining discharge for a number of times in accordance with weighting of the plurality of sub fields of said first sub field group; and B) providing a second sub field group which includes a plurality of sub fields following the first sub field group such that each sub field of said second sub field group includes a selected light-extinction address stage for selectively causing only a discharge cell which performs the light-emission-sustaining discharge in an immediately preceding sub field, to perform light-extinction discharge in accordance with the picture signal so as to set the discharge cell into a light extinguishing mode, and also includes a light emission maintaining stage for repeatedly causing only the discharge cell set in the lighting mode to perform light-emission-sustaining discharge for a number of times in accordance with weighting of the plurality of sub fields of said second sub field group, wherein the plurality of sub fields in each said field emit light successively from the head sub field to the tail sub field to increase luminance.

* * * * *